US008600280B2

(12) United States Patent
Nanjo

(10) Patent No.: US 8,600,280 B2
(45) Date of Patent: Dec. 3, 2013

(54) FIXING DEVICE AND IMAGE FORMING APPARATUS INCLUDING THE SAME

(75) Inventor: Yuzuru Nanjo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 235 days.

(21) Appl. No.: 13/043,077

(22) Filed: Mar. 8, 2011

(65) Prior Publication Data

US 2011/0217097 A1 Sep. 8, 2011

(30) Foreign Application Priority Data

Mar. 8, 2010 (JP) ..... 2010-050040
Oct. 26, 2010 (JP) ..... 2010-239519

(51) Int. Cl.
*G03G 15/20* (2006.01)

(52) U.S. Cl.
USPC ..... 399/335

(58) Field of Classification Search
USPC ..... 399/329, 122, 330, 335
See application file for complete search history.

(56) References Cited

U.S. PATENT DOCUMENTS 5,465,146 A 11/1995 Higashi et al.
RE36,962 E 11/2000 Higashi et al.
7,486,923 B2 * 2/2009 Imai et al. ..... 399/333
2009/0060550 A1 3/2009 Seo
2009/0175664 A1 7/2009 Nanjo et al.
2009/0263168 A1 * 10/2009 Baba ..... 399/329
2009/0290915 A1 * 11/2009 Baba ..... 399/329
2009/0290917 A1 * 11/2009 Baba et al. ..... 399/329
2009/0317155 A1 * 12/2009 Murakami et al. ..... 399/329
2010/0028061 A1 * 2/2010 Nanjo et al. ..... 399/328

FOREIGN PATENT DOCUMENTS

JP 6-318001 11/1994
JP 2004-151470 5/2004
JP 2006-292815 A 10/2006
JP 2009-058829 A 3/2009
JP 2009-162995 A 7/2009
JP 2009-163015 A 7/2009

* cited by examiner

*Primary Examiner* — Walter L Lindsay, Jr.
*Assistant Examiner* — Rodney Bonnette
(74) *Attorney, Agent, or Firm* — Frommer Lawrence & Haug LLP

(57) ABSTRACT

A fixing device includes a rotating fixing body fixes a toner image on a recording medium by heating, the rotating fixing body having a cylindrical metal core formed of a magnetic shunt alloy and having a thickness less than a magnetic-field permeation depth at a temperature higher than or equal to a Curie temperature of the metal core, a coil provided along an outer surface of the rotating fixing body so as to generate magnetic flux that subjects the rotating fixing body to induction heating, and an electrically conductive arch-shaped saddle ring member disposed at a position opposing the coil with the metal core being disposed therebetween and in an orientation such that magnetic flux leakage associated with loss of ferromagnetism of the metal core penetrates the ring member.

19 Claims, 8 Drawing Sheets

MAGNETIC-FIELD PERMEATION DEPTH $$503 \times (\rho / (f \cdot \mu))^{0.5}$$

ρ :RESISTANCE (Ω·m)

μ : MAGNETIC PERMEABILITY f : FREQUENCY

MAGNETIC-FIELD PERMEATION DEPTH OF MAGNETIC SHUNT ALLOY

| RESISTANCE ρ (Ω·m) | RELATIVE MAGNETIC PERMEABILITY μ | FREQUENCY f (KHz) | MAGNETIC-FIELD PERMEATION DEPTH (mm) |
|---|---|---|---|
| 8.00E-07 | 10000 (*1) | 25 | 0.028 |
| 8.00E-07 | 1(*2) | 25 | 2.845 |

*1: AT TEMPERATURE LOWER THAN THE CURIE TEMPERATURE

*2: AT TEMPERATURE HIGHER THAN OR EQUAL TO THE CURIE TEMPERATURE

FIG. 3

FIXING DEVICE AND IMAGE FORMING APPARATUS INCLUDING THE SAME

INCORPORATION BY REFERENCE

This application is based upon and claims the benefit of priority from the corresponding Japanese Patent application No. 2010-050040, filed Mar. 8, 2010 and Japanese Patent application No. 2010-239519, filed Oct. 26, 2010, the entire contents of which are incorporated herein by reference.

FIELD OF THE INVENTION

The present disclosure relates to a fixing device that fixes a toner image on a recording medium by melting and fusing unfixed toner image with heat while passing the recording medium carrying the toner image through a nip between a pair of fixing rollers or a nip between a heating belt and a roller. The present disclosure also relates to an image forming apparatus including the fixing device.

BACKGROUND OF THE INVENTION

In recent image forming apparatuses, a belt fixing system that has a lower heat capacity has attracted attention in response to requests for a shorter warm-up time (a period from when an image forming apparatus is powered on to when fixing by a fixing device becomes ready) and energy saving in the fixing device. Also, in recent years, an electromagnetic induction heating (IH) technique capable of rapid heating and high-efficiency heating has attracted attention as a heating technique adopted in the fixing device. From the viewpoint of energy saving in fixing of color images, a large number of fixing devices utilizing the electromagnetic induction heating technique and the belt fixing system in combination have been commercialized. When the belt fixing system and the electromagnetic induction heating technique are used in combination, a device (coil) for generating magnetic flux for electromagnetic induction heating is often provided on the outside of a heating belt because this arrangement provides advantages such as ease of layout and cooling of the coil and direct heating of the belt (so-called external IH system).

In the above-described electromagnetic induction heating technique, there is known a technique of preventing an excessive temperature rise of the fixing device. More specifically, a fixing roller includes a magnetic shunt alloy layer and a nonmagnetic metal layer, and a coil and the nonmagnetic metal layer oppose each other with the magnetic shunt alloy layer being disposed therebetween. The thickness of the magnetic shunt alloy layer is set to be less than a magnetic-field permeation depth (a surface skin depth) at a temperature higher than or equal to the Curie temperature.

Thus, when the temperature of the magnetic shunt alloy layer is lower than the Curie temperature, a magnetic flux generated by the coil does not reach the nonmagnetic metal layer, and the magnetic shunt alloy layer generates heat. When this heat generation of the magnetic shunt alloy layer increases the temperature of the magnetic shunt alloy layer to be higher than or equal to the Curie temperature, the magnetic flux generated by the coil penetrates the magnetic shunt alloy layer, and reaches the nonmagnetic metal layer, so that an induced current is generated in the nonmagnetic metal layer. The magnetic flux penetrating the magnetic shunt alloy layer and a magnetic flux in a direction opposite the penetrating magnetic flux, which is generated by the induced current in the nonmagnetic metal layer, cancel each other. This suppresses heat generation in the nonmagnetic shunt alloy layer.

However, even when the above techniques of the related art are combined, there remain problems with further reduction of heat capacity of the fixing device. For example, it is conceivable that the heat capacity can be further reduced in the combination by decreasing the thicknesses of the layers. However, if the thicknesses of the layers are simply reduced, the heating efficiency or the magnetic flux reducing effect becomes more likely to decrease.

More specifically, if the thickness of the magnetic shunt alloy layer is reduced, the magnetic flux generated by the coil easily penetrates the magnetic shunt alloy layer. With this, this magnetic flux and the opposite-direction magnetic flux generated by the nonmagnetic metal layer cancel each other, so that the heat generation efficiency of the magnetic shunt alloy layer decreases. In contrast, if the thickness of the nonmagnetic metal layer is reduced, the sectional area where the induced current passes decreases, and the electric resistance of the nonmagnetic metal layer increases. As a result, the opposite magnetic flux is not easily generated.

SUMMARY OF THE INVENTION

Accordingly, according to some aspects of the present disclosure, the present disclosure is related to a fixing device that solves the above problems and that realizes further reduction of heat capacity, and an image forming apparatus including the fixing device.

A fixing device according to an aspect of the present disclosure includes a rotating fixing body configured to rotate on an axis extending in a width direction of a recording medium to be conveyed and to fix a toner image on the recording medium by heating, the rotating fixing body having a cylindrical metal core formed of a magnetic shunt alloy and having a thickness less than a magnetic-field permeation depth at a temperature higher than or equal to a Curie temperature; a coil provided along an outer surface of the rotating fixing body, the coil configured for generating magnetic flux that subjects the rotating fixing body to induction heating; and an electrically conductive arch-shaped saddle ring member, the ring member being disposed at a position opposing the coil with the metal core being disposed therebetween and in an orientation such that the magnetic flux leakage associated with loss of magnetism of the metal core penetrates the ring member.

The above and other objects, features, and advantages of various embodiments of the present disclosure will be more apparent from the following detailed description of embodiments taken in conjunction with the accompanying drawings. It will be appreciated by those skilled in the art that the foregoing brief description and the following detailed description are exemplary and explanatory of the present disclosure, but are not intended to be restrictive thereof or limiting of the advantages which can be achieved by this disclosure. Accordingly, the present disclosure serves to explain principles of embodiments of the disclosure, thus providing a better understanding of the disclosure, as well as operating advantages and specific objects that may be attained by some of its uses. Additionally, it is understood that the foregoing summary is representative of some embodiments of the disclosure, and is neither representative nor inclusive of all subject matter and embodiments within the scope of the present disclosure. Various features of novelty which characterize various aspects of the disclosure are pointed out in particularity in the claims annexed to and forming a part of this disclosure.

In this text, the terms "comprising", "comprise", "comprises" and other forms of "comprise" can have the meaning ascribed to these terms in U.S. Patent Law and can mean "including", "include", "includes" and other forms of "include".

BRIEF DESCRIPTION OF THE DRAWINGS

Aspects, features, and advantages of various embodiments of the disclosure, both as to structure and operation, will be understood and will become more readily apparent when the disclosure is considered in the light of the following description of illustrative embodiments made in conjunction with the accompanying drawings, in which like reference numerals designate the same or similar parts throughout the various figures, and wherein:

FIG. 3 explains a magnetic-field permeation depth of a magnetic shunt alloy, in accordance with some embodiments;

DETAILED DESCRIPTION OF EMBODIMENTS

Figure 1:
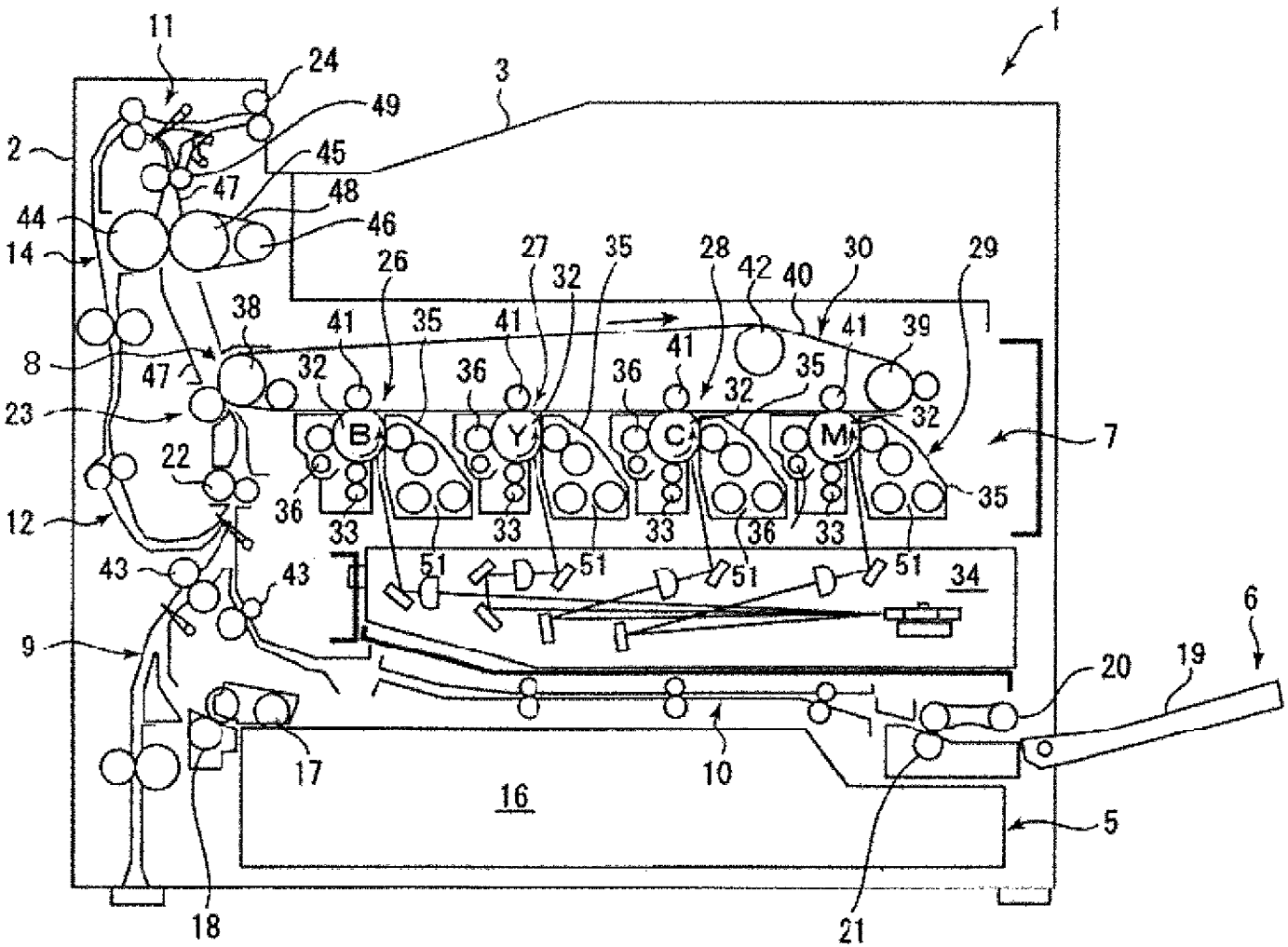
FIG. 1 schematically illustrates a configuration of an image forming apparatus according to some embodiments.

FIG. 1 schematically illustrates a configuration of an image forming apparatus 1 according to some embodiments of the present disclosure. The image forming apparatus 1 can be a printer that performs printing by transferring a toner image onto a surface of a sheet P, serving as an example of a recording medium, on the basis of externally input image information, a copying machine, a facsimile machine, or a multifunctional peripheral that has the above functions in combination. In the following embodiments, the recording medium is not limited to the sheet P, and may be other recording media (e.g., an OHP sheet).

The image forming apparatus 1 illustrated in FIG. 1 is a tandem type color printer. The image forming apparatus 1 includes an apparatus main body 2 shaped like a rectangular box in which a color image is formed (printed) onto the sheets P. On an upper surface of the apparatus main body 2, an output tray 3 is provided to receive output sheets P on which color images have been printed.

At the inner bottom of the apparatus main body 2, a paper feed cassette 5 that stores sheets P is provided. Further, a stack tray 6 is provided at a right side surface of the apparatus main body 2 so as to supply sheets P, which are not stored in the paper feed cassette 5, into the apparatus main body 2. An image forming section 7 is provided in an upper part of the apparatus main body 2, and forms a toner image on a sheet P on the basis of image information, such as characters and pictures, transmitted from a host apparatus (e.g., a personal computer (PC)) connected to the image forming apparatus 1.

A first conveying path 9 through which a sheet P fed out from the paper feed cassette 5 is conveyed to a below-described secondary transfer unit 23 is provided in a left part of the apparatus main body 2 in FIG. 1. A second conveying path 10 through which a sheet P fed out from the stack tray 6 is conveyed to the secondary transfer unit 23 is provided from a right part to the left part of the apparatus main body 2. Also, a fixing unit (fixing device) 14 and a third conveying path 11 are provided in an upper left part of the apparatus main body 2. The fixing unit 14 conducts fixing on a sheet P of a toner image that has been transferred onto the sheet P in the secondary transfer unit 23. After fixing, the sheet P is conveyed to the output tray 3 through the third conveying path 11.

In a state in which the paper feed cassette 5 is pulled out of the apparatus main body 2 (for example, to the front side of the plane of FIG. 1), sheets P can be replenished in the paper feed cassette 5. The paper feed cassette 5 includes a storage portion 16 that can selectively store one of at least two types of sheets P having different sizes in the paper feed direction. When the image forming apparatus 1 performs image formation, sheets P stored in the storage portion 16 are fed into the first conveying path 9 one by one by a paper feed roller 17 and a pair of separating rollers 18.

The stack tray 6 can open and close relative to an outer surface of the apparatus main body 2. One or a plurality of sheets P is placed on a manual feed portion 19 of the stack tray 6. Sheets P placed on the manual feed portion 19 are fed out into the second conveying path 10 one by one by a pickup roller 20 and a pair of separating rollers 21.

The first conveying path 9 and the second conveying path 10 join together on the upstream side of a pair of registration rollers 22. The conveyed sheet P is temporarily stopped at the registration rollers 22, and is then conveyed toward the secondary transfer unit 23 after being subjected to skew correction and timing adjustment.

In the secondary transfer unit 23, a full-color toner image is secondarily transferred from an intermediate transfer belt 40 onto the conveyed sheet P. After that, the toner image is fixed on the sheet P by the fixing unit 14. As required, the sheet P is reversed in a fourth conveying path 12, and a full-color toner image is also secondarily transferred on an opposite surface of the sheet P in the secondary transfer unit 23. After the full-color toner image is fixed on the opposite surface by the fixing unit 14, the sheet P bearing the color images on both surfaces passes through the third conveying path 11, and is output to the output tray 3 by a pair of output rollers 24.

The image forming section 7 includes four image forming units 26, 27, 28, and 29 that respectively form toner images of black (B), yellow (Y), cyan (C), and magenta (M) colors, an intermediate transfer unit 30 that carries the color toner images formed by the image forming units 26, 27, 28, and 29 in the superimposed manner, and a laser scanning unit 34 that is disposed below the image forming units 26, 27, 28, and 29 and irradiates with laser beams photoconductor drums 32 (described below), in the image forming units 26, 27, 28, and 29, respectively, at a specific portion of the surface of the photoconductor drums 32 downstream of a charging unit 33 described below in the rotation direction of the photoconductor drums 32.

Each of the image forming units 26, 27, 28, and 29 includes the photoconductor drum 32 (image carrier), the charging unit 33, a developing unit 35, and a cleaning unit 36. The charging unit 33 is provided to oppose a peripheral surface of the photoconductor drum 32. The developing unit 35 opposes the peripheral surface of the photoconductor drum 32 on the downstream side of the laser beam applied position in the rotating direction of the photoconductor drum 32. The cleaning unit 36 opposes the peripheral surface of the photoconductor drum 32 on the downstream side of the developing unit 35 in the rotating direction of the photoconductor drum 32.

In each of the image forming units 26, 27, 28, and 29, each of the photoconductor drums 32 is rotated counterclockwise in FIG. 1 by a driving motor (not shown). In each developing unit 35, a developing device 51 stores two-component developer containing each of black toner, yellow toner, cyan toner, and magenta toner, respectively.

The intermediate transfer unit 30 includes a driving roller 38 disposed near the image forming unit 26, a driven roller 39 disposed near the image forming unit 29, a tension roller 42 disposed above the image forming unit 28, an intermediate transfer belt 40 wound around the driving roller 38, the driven roller 39 and the tension roller 42, and four primary transfer rollers 41. The primary transfer rollers 41 are in pressing contact with the photoconductor drums 32 in the image forming units 26, 27, 28, and 29 at positions on the photoconductor drums 32 on the downstream sides of the developing units 35 in the rotating direction of the photoconductor drums 32, respectively, in a manner such that the intermediate transfer belt 40 is located between the primary transfer rollers 41 and the photoconductor drums 32.

In the intermediate transfer unit 30, different color toner images on the photoconductor drums 32 in the image forming units 26, 27, 28, and 29 are transferred and superimposed on the intermediate transfer belt 40 at the corresponding primary transfer rollers 41, thereby finally forming a full-color toner image. The secondary transfer unit 23 and the intermediate transfer unit 30 constitute a transfer section 8.

The first conveying path 9 and the second conveying path 10 convey sheets P sent from the paper feed cassette 5 and the stack tray 6 toward the secondary transfer unit 23, and include a plurality of pairs of conveying rollers 43 at predetermined positions in the apparatus main body 2, and a pair of registration rollers 22 disposed on the upstream side of the secondary transfer unit 23. The registration rollers 22 serve to adjust timing between an image forming operation in the image fanning section 7 and a sheet feed operation.

The fixing unit 14 heats and pressurizes the sheet P on which a toner image is transferred in the secondary transfer unit 23 so as to fix the unfixed toner image on the sheet P. The fixing unit 14 includes a pair of fixing rollers, that is, a pressurizing roller 44 and a fixing roller 45. The pressurizing roller 44 includes a metal core, an elastic surface layer (e.g., silicone rubber), and a release layer (e.g., tetrafluoroethylene-perfluoroalkylvinyl ether copolymer resin: PFA). The fixing roller 45 includes a metal core and an elastic surface layer (e.g., silicone sponge). Also, a cylindrical heat roller (rotating fixing body) 46 is provided adjacent to the fixing roller 45. A heating belt 48 is wound around the heat roller 46 and the fixing roller 45. A detailed structure of the fixing unit 14, according to some embodiments, will be described below.

Conveying paths 47 are provided on the upstream and downstream sides of the fixing unit 14 in the sheet conveying direction, respectively. A sheet P conveyed through the secondary transfer unit 23 passes through the upstream conveying path 47, and is led to a fixing nip between the pressurizing roller 44 and the fixing roller 45 (heating belt 48). Then, the sheet P passing through the nip between the pressurizing roller 44 and the fixing roller 45 is led to the third conveying path 11 through the downstream conveying path 47.

Through the third conveying path 11, the sheet P subjected to fixing by the fixing unit 14 is output to the output tray 3. For this reason, a pair of conveying rollers 49 is provided at an appropriate position in the third conveying path 11, and the above-described pair of output rollers 24 is provided at the exit of the third conveying path 11.

Next, a detailed description will be given of the fixing unit 14 applied to the image forming apparatus 1 according to some illustrative embodiments. It will be understood that various values of approximate dimensions and/or parameters are provided simply by way of example for purposes of clarity, and are not intended to be limiting of the present disclosure.

Figure 2:
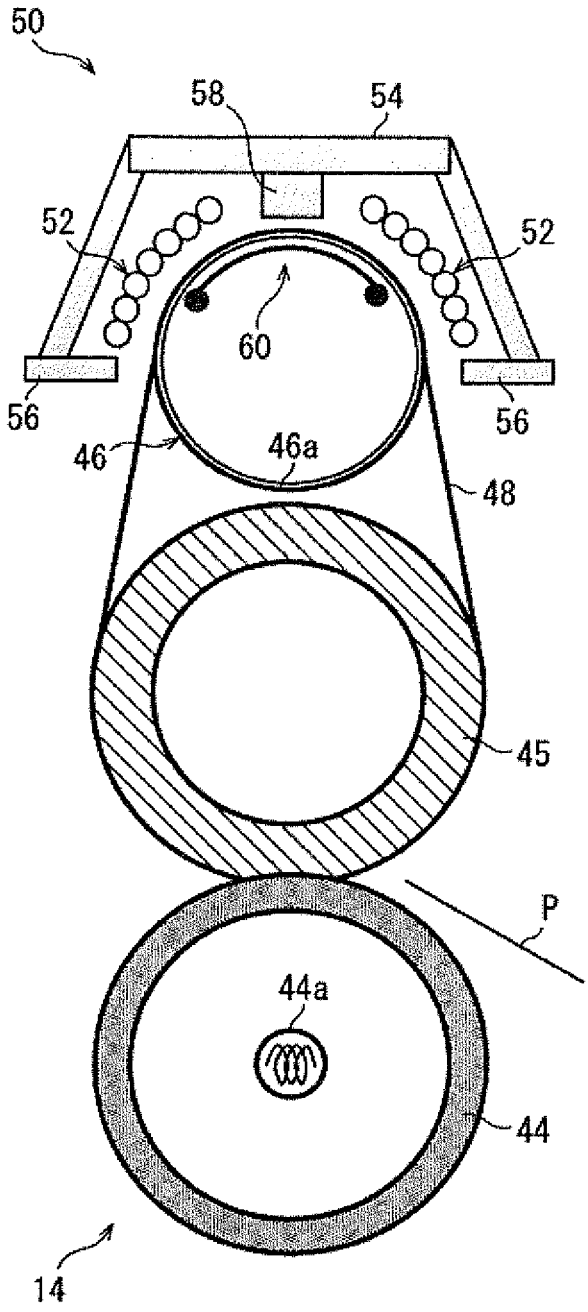
FIG. 2 is a cross-sectional view illustrating an exemplary structure of a fixing unit, in accordance with some embodiments.

FIG. 2 is a cross-sectional view illustrating an illustrative structure of the fixing unit 14, in accordance with some embodiments. The fixing unit 14 illustrated in FIG. 2 is in an orientation rotated about 90° counterclockwise from an orientation in which the fixing unit 14 is mounted in the apparatus main body 2. Therefore, while the sheet conveying direction extends from the lower side toward the upper side in FIG. 1, the sheet conveying direction extends from the right side to the left side in FIG. 2. When the apparatus main body 2 is larger (for example, in the case of a multi-functional peripheral), the fixing unit 14 is sometimes mounted in the apparatus main body 2 in the orientation of FIG. 2. Alternatively, the fixing unit 14 is sometimes mounted in the apparatus main body 2 while being inclined to the right or left from the orientation of FIG. 2.

As described above, the fixing unit 14 of the illustrative embodiment includes the pressurizing roller 44, the fixing roller 45, the heat roller 46, and the heating belt 48. By way of example, the pressurizing roller 44 is a roller having a diameter of about 50 mm, in which a silicone rubber layer having a thickness of about 2 to about 5 mm is provided on a metal (e.g., SUS: stainless used steel) core and a release layer (e.g., PFA: tetrafluoroethylene perfluoroalkoxy vinyl ether copolymer resin) is further provided on a surface of the silicone rubber layer. The fixing roller 45 is a roller having a diameter of about 45 mm, in which a silicone rubber sponge layer having a thickness of about 5 to about 10 mm is provided on a metal (SUS) core.

The heat roller 46 includes a cylindrical metal core **46*a* made of a magnetic shunt metal (e.g., a Fe—Ni alloy) and having a diameter of about 30 mm and a thickness of about 0.2 to about 1.0 mm. A release layer (e.g., PFA) is provided on a surface of the metal core 46*a***. A magnetic shunt alloy, such as a Fe—Ni alloy, will be described below.

The heating belt 48 may be a resin belt that does not have a heating function and has a base layer of about 35 μm (1 $\mu m = 1\times10^{-6}$ m) in thickness that is made of a nonmagnetic material (e.g., PI: polyimide). An elastic layer (e.g., silicone rubber) having a thickness of about 200 to about 500 μm may be provided on a surface of the base layer, and a release layer (e.g., PFA) may be further provided on an outer surface of the elastic layer.

Since the fixing roller 45 has the elastic layer of silicone rubber sponge on the surface side, as described above, a flat fixing nip is formed between the heating belt 48 and the pressurizing roller 44. A sheet P conveyed through the secondary transfer unit 23 is led into the fixing nip. Further, the pressurizing roller 44 is shaped like a hollow cylinder, and a halogen heater **44*a* is provided in an inner space of the pressurizing roller 44**.

In addition, the fixing unit 14 includes an IH (Induction Heating) coil unit 50 on an outer side of the heat roller 46 and the heating belt 48 (not shown in FIG. 1). The IH coil unit 50 includes an induction heating coil 52, a plurality of pairs of arch cores 54, a pair of side cores 56, and a center core 58.

In accordance with some embodiments, such as that illustrated in FIG. 2, the induction heating coil (coil) 52 is provided on an imaginary arc in cross section extending along an arc-shaped outer surface portion of the heat roller 46, in cross section, opposing the IH coil unit 50 so that induction heating is performed at the arc-shaped portion of the heat roller 46 in cross section. Also, a coil bobbin (not shown) is provided on the outer side of the heat roller 46 and the heating belt 48, and the induction heating coil 52 is wound on the coil bobbin in a ring shaped manner. The coil bobbin may be formed of a heat resistant resin (e.g., PPS: polyphenylene sulfide resin, PET: polyethylene terephthalate resin, LCP: liquid crystal polymer resin). The coil 52 may be fixed to the coil bobbin with a silicone adhesive.

Referring to FIG. 2, the center core 58 is provided in the center of the IH coil unit 50, and the arch cores 54 and the side cores 56 described above are arranged in pairs on both sides of the center core 58. The arch cores 54 on both sides are formed of ferrite and are shaped symmetrically with respect to the center core 58 so as to have an arch-shaped cross section. The overall length of the arch cores 54 is larger than the length of an area where the induction heating coil 52 is provided. The side cores 56 on both sides are shaped like a block and formed of ferrite. Also, the side cores 56 are connected to ends (lower ends in FIG. 2) of the arch cores 54, respectively. The side cores 56 cover the area where the induction heating coil 52 is provided.

The arch cores 54 are provided at a plurality of positions arranged spaced in the longitudinal direction of the heat roller 46. In contrast, the side cores 56 are arranged in succession in the longitudinal direction of the heat roller 46 without any interval therebetween. The overall lengths of areas where the side cores 56 are arranged correspond to the length of the area where the induction heating coil 52 is provided. The positions of the arch cores 54 and the side cores 56 are determined in accordance with a magnetic flux density (magnetic field strength) of the induction heating coil 52. Since the arch cores 54 are arranged at some intervals, the side cores 56 complement the magnetic flux concentrating effect in the intervals, so that the magnetic flux density distribution (temperature distribution) is averaged in the longitudinal direction of the heat roller 46.

A core holder (not shown) made, for example, of a resin may be provided on the outer side of the arch cores 54 and the side cores 56, and supports the arch cores 54 and the side cores 56. The core holder is, for example, also formed of a heat resistant resin (e.g., PPS, PET, or LCP).

A thermistor may be provided in contact with a inner surface of the heat roller 46 in a portion of the heat roller 46 where amount of heat generation by induction heating is more than that of other parts of the heat roller 46. More practically, the outer surface temperature of the heating belt 48 can be detected with a non-contact temperature sensor provided below the IH coil unit 50 and opposing the heating belt 48.

In accordance with some embodiments, the center core 58 is formed of ferrite and has a rectangular cross section. Substantially similarly to the heat roller 46, the center core 58 has a length corresponding to the maximum sheet passing width of, for example, 13 inches (about 340 mm). The center core 58 is fixed to the arch cores 54 and, in some implementations, may be provided integrally with the arch cores 54.

The above-described metal core 46*a* formed of a Fe—Ni alloy in the heat roller 46 can generate heat by magnetic flux from the induction heating coil 52. More specifically, the metal core 46*a* has magnetic permeability and electric conductivity, and exhibits ferromagnetism at room temperature. However, when the temperature of the metal core 46*a* becomes higher than or equal to a predetermined temperature (Curie temperature, which, for the Fe—NI alloy of the illustrative embodiment, is about 200° C.), the ferromagnetism disappears, and the magnetic permeability becomes about 1. That is, the metal core 46*a* becomes nonmagnetic (paramagnetic) (magnetic shunting), and is capable of self temperature control.

The metal core 46*a* of the embodiment is formed to have a thickness (e.g., 0.2 mm) less than a magnetic-field permeation (penetration) depth provided when the temperature of the metal core 46*a* becomes higher than or equal to the Curie temperature of the metal core 46*a*.

As depicted in FIG. 3 in connection with an example using a Fe—Ni alloy, the field permeation depth of the metal core 46*a* can be calculated using a resistance $\rho$ of the magnetic shunt alloy, the magnetic permeability $\mu$ of the magnetic shunt alloy at the Curie temperature, and a power supply frequency f to be applied to the coil 52. As shown by the illustrative calculation tabulated in FIG. 3, the magnetic-field permeation depth of the metal core 46*a* greatly changes according to the Curie temperature (FIG. 3). In accordance with some embodiments, to set the Curie temperature of the metal core 46*a* to be about 200° C., the Ni content of the Fe—Ni alloy is about 30% to about 40%. If the metal core has a thickness more than or equal to the magnetic-field permeation depth at a temperature higher than or equal to the Curie temperature of the metal core 46*a*, an induced current is generated by magnetic flux generated by the coil 52 and a diamagnetic field is generated, so that the magnetic flux from the coil 52 can be blocked (flux reducing effect).

In contrast, when the thickness of the metal core 46*a* is a thickness less than the magnetic-flux permeation depth at the temperature higher than or equal to the Curie temperature of the metal core 46*a*, such as 0.2 mm, as in the embodiment, the magnetic flux generated by the coil 52 substantially passes through inside the metal core 46*a* along the surface of metal core 46*a* when the temperature of the metal core 46*a* is less than the Curie temperature. In contrast, when the temperature of the metal core 46*a* becomes higher than or equal to the Curie temperature, leakage flux passing through the metal core 46*a* in the thickness direction of the metal core 46*a* and traveling toward the side opposite the coil 52, that is, toward a ring member 60, which will be described below, is generated.

Figure 4:
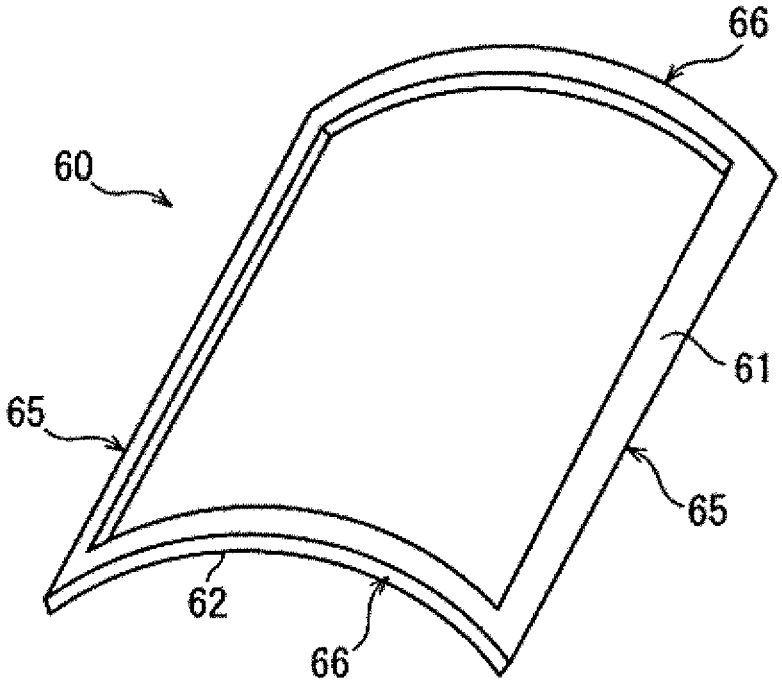
FIG. 4 is an external perspective view of a ring member, in accordance with some embodiments.

The ring member 60 of the illustrative embodiment is disposed at a position opposing the coil 52 with the metal core 46*a* being disposed therebetween, more specifically, to an inner portion of the heat roller 46 (refer to FIG. 2). For example, as illustrated in FIG. 4, the ring member 60 is curved in an arc form as a whole to be arch-shaped in side view and to be rectangular-shaped with a hollow inside thereof in top view. An upper surface 61 of the ring member 60 faces an inner surface of the metal core 46*a*, and a lower surface 62 of the ring member 60 faces a rotation shaft of the heat roller 46.

The ring member 60 includes two linear portions 65 parallel to the axial direction of the heat roller 46, and two arch-shaped portions 66 that connect longitudinal ends of the linear portions 65. A hollow space is defined in an inner side of the ring member 60 by the linear portions 65 and the arch-shaped portions 66. Also, the ring member 60 is shaped like a hollow rectangle, as viewed from above.

It will be understood that the longitudinal ends of linear portions 65, while depicted as intersecting the arch-shaped portions 66 at sharp corners (e.g., right angles), in various implementations they may intersect at tapered or rounded corners. Additionally, while the arch-shaped portions 66 may be circular arcs, in various implementations they may have a non-circular curvature; for example, they may be implemented as an elliptic arc or parabolic arc. For ease of reference and clarity of exposition, a ring member having the general shape as described is referred to herein as an arch-shaped saddle ring (or arch-shaped saddle ring member). As will thus be understood, as used herein, an arch-shaped saddle ring may have arch-shaped portions implemented as, for example, circular arcs, parabolic arcs, or elliptic arcs. Also for convenience, an arch-shaped saddle ring (member) having arch-shaped portions formed as circular arcs is referred to herein as a cylindrical saddle ring. The ring member 60 may be integrally formed, or may be formed by joining two or more formed portions (e.g., linear and arch-shaped portions) thereof.

Further, the ring member 60 is a nonmagnetic and highly electrically conductive material such as oxygen-free copper, and has a thickness ranging, for example, from about 0.1 mm to about 4 mm (e.g., 1 to 2 mm). The thickness of the ring member 60 may be uniform in the peripheral direction. The ring member 60 serves to suppress heat generation in the metal core 46*a* even if the temperature is higher than or equal to the Curie temperature.

Figure 5A:
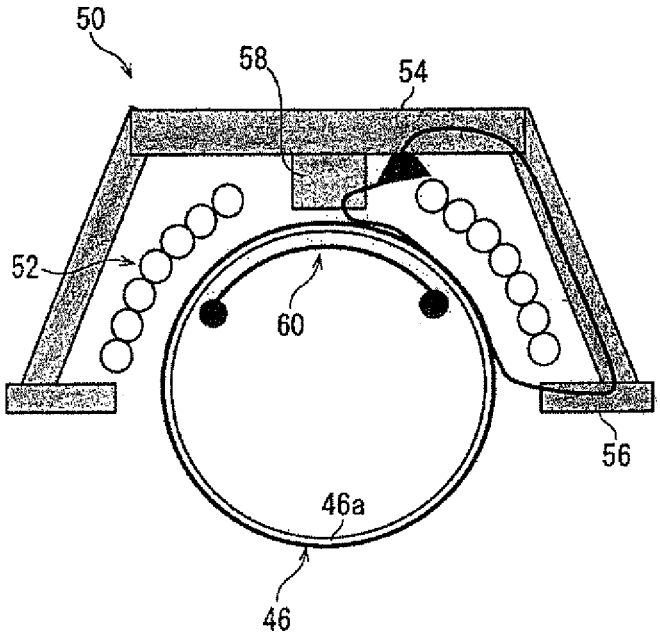
FIG. 5A illustrates the direction of magnetic flux provided when the temperature of the magnetic shunt alloy is lower than a Curie temperature, in accordance with some embodiments.

Specifically, since the thickness of the metal core 46*a* is less than the magnetic-field permeation depth at the temperature higher than or equal to the Curie temperature of the metal core 46*a*, as described above, if the temperature of the metal core 46*a* is lower than the Curie temperature, a magnetic flux generated by the induction heating coil 52 substantially travels in the metal core 46*a* via the side cores 56, the arch cores 54, and the center core 58, as shown by a solid arrow in FIG. 5A. More specifically, the magnetic flux generated by the induction heating coil 52 travels toward the side cores 56 after traveling through inside the metal core 46*a*. In this case, eddy current is generated in the metal core 46*a* of the heat roller 46, and Joule heat is generated in the metal core 46*a* owing to a specific resistance of the metal core 46*a*, thereby heating the metal core 46*a*.

Figure 5B:
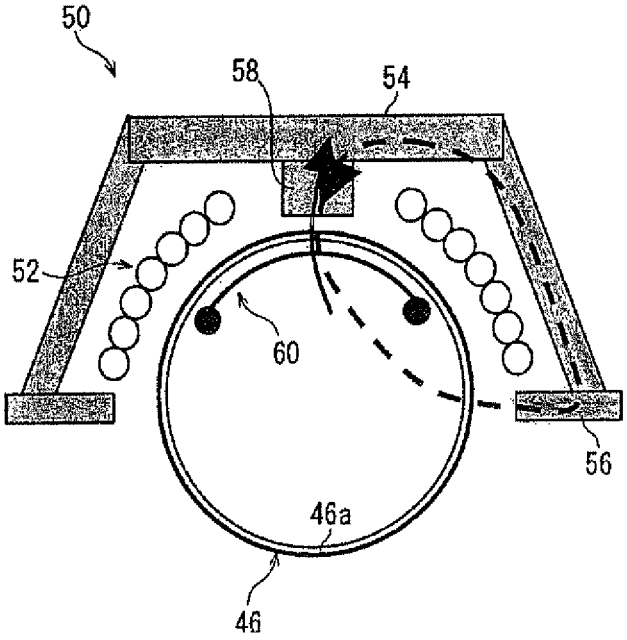
FIG. 5B illustrates the direction of magnetic flux provided when the temperature of the magnetic shunt alloy is higher than or equal to the Curie temperature, in accordance with some embodiments.

In contrast, when the temperature of the metal core 46*a* becomes higher than or equal to the Curie temperature, the ferromagnetism of the metal core 46*a* disappears, and the magnetic permeability becomes about 1, so that the magnetic-field permeation depth greatly increases (see FIG. 3). For this reason, a leakage flux passing through the metal core 46*a* in the thickness direction and traveling toward the ring member 60 is generated, as shown by a dashed arrow in FIG. 5B.

Figure 6:
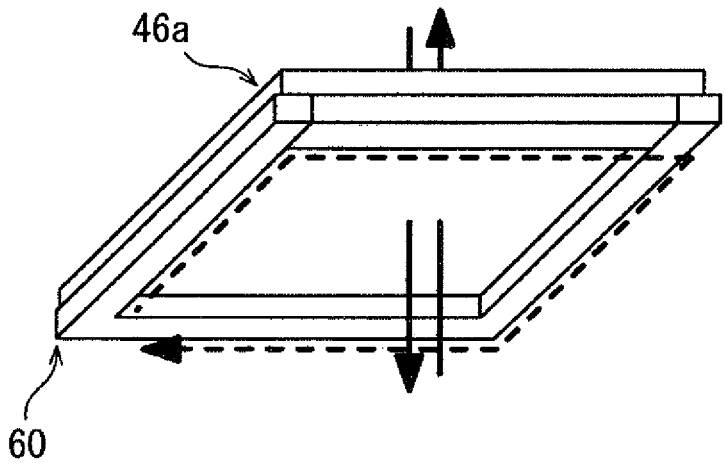
FIG. 6 is an illustration for explaining a flux reducing effect in the case of FIG. 5B, in accordance with some embodiments.

This leakage flux is shown by a downward-pointing solid arrow in FIG. 6. The ring member 60 is fixed in an orientation such that the leakage flux penetrates an imaginary plane in the rectangle in a substantially perpendicular direction. For this reason, a diamagnetic field whose direction is opposite to the direction of the leakage flux (shown by an upward-pointing solid arrow in FIG. 6) is generated by the ring member 60 by an induced current generated in the ring member 60 by the leakage flux (shown by a broken arrow in FIG. 6). Since the diamagnetic field acts in a direction to cancel the leakage flux (vertical penetrating magnetic field), it blocks or reduces the magnetic flux (the leakage flux) from the induction heating coil 52 (flux reducing effect).

By forming the ring member 60 of a highly conductive member, generation of Joule heat by the induced current is suppressed and the flux from the induction heating coil 52 is efficiently blocked or reduced.

Figure 7:
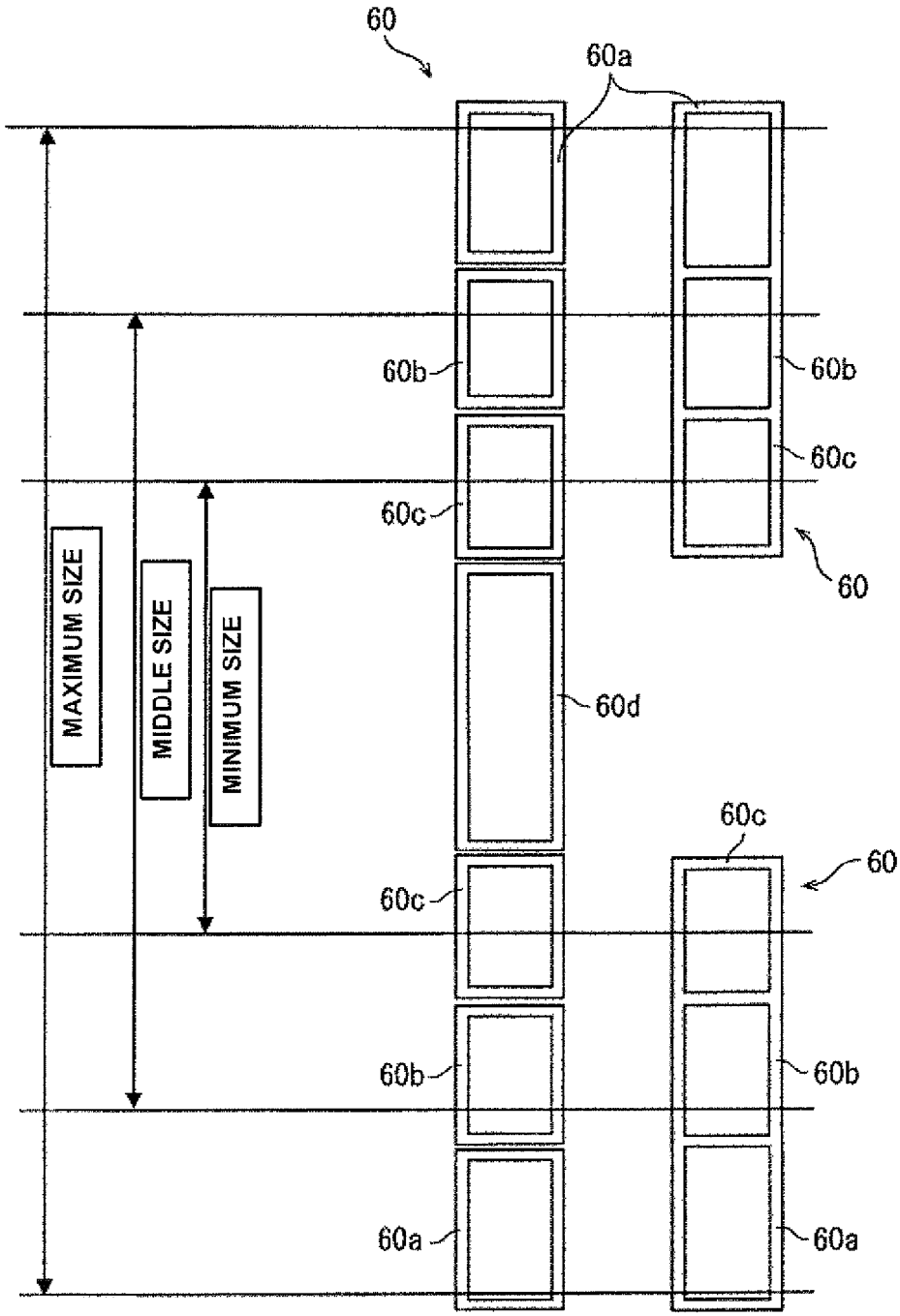
FIG. 7 is a plan view of the ring member provided in the fixing unit, in accordance with some embodiments.

As illustrated in FIG. 7, the ring member 60 of the illustrative embodiment is divided into a plurality of parts. More specifically, the ring member 60 includes at least three types of rings 60*a*, 60*b*, and 60*c*. The rings 60*a*, 60*b*, and 60*c* are separately arranged in the axial direction (longitudinal direction) of the heat roller 46 (FIG. 7), and are supported by a member such as a cover (not shown) of the fixing unit 14.

The lengths of the rings 60*a*, 60*b*, and 60*c* in the axial direction of the heat roller 46 are different corresponding to a plurality of widths of sheets P to be conveyed (lengths of the sheets P perpendicular to the sheet conveying direction). The rings 60*a*, 60*b*, and 60*c* may be separately formed like a ring member 60 illustrated on the left side of FIG. 7 or may be integrally formed like a ring member 60 illustrated on the right side of FIG. 7 as long as the rings 60*a*, 60*b*, and 60*c* have the same thickness.

The three types of rings 60*a*, 60*b*, and 60*c* are arranged symmetrically with respect to a center of the axis of the heat roller 46. The rings 60*a* are provided corresponding to both ends of the heat roller 46, and the rings 60*b* and 60*c* are arranged in order from the ends toward the center. The innermost rings 60*c* (closest to the center) are provided outside a passing range of sheets P of the minimum size. The rings 60*b* are provided outside a passing range of sheets P of the middle size, and the rings 60*a* are provided outside a passing range of sheets P of the next larger size (maximum size).

For example, this arrangement can respond to four sheet sizes, that is, the maximum sheet size of 13 inches (340 mm) and three smaller sheet sizes. The three smaller sheet sizes are the A3-size (297 mm), the A4 portrait size (210 mm), and the A5 portrait size (149 mm). A ring 60*d* illustrated on the left side of FIG. 7 prevents the temperature of the heat roller 46 from excessively becoming higher when temperature control with the above-described thermistor becomes difficult. However, the ring 60*d* may be omitted, as on the right side of FIG. 7.

By way of example, in accordance with various embodiments, a slide belt (fixing belt member) 68 may be used instead of the heat roller 46 and the fixing roller 45 described above. More specifically, in various alternative implementations of fixing unit 14, such as that illustrated in FIG. 8, components having the same functions as those of the above embodiment are denoted by the same reference numerals, and descriptions thereof are omitted. The fixing unit 14 includes a pressurizing roller 44 and the flexible slide belt 68. A sheet P conveyed through a secondary transfer unit 23 is led into a fixing nip between the pressurizing roller 44 and the slide belt 68.

More specifically, the pressurizing roller 44 is a roller having a diameter of about 25 mm, in which a silicone rubber layer having a thickness of about 2 to about 5 mm is provided on a metal (e.g., SUS) core and is covered with a PFA tube. The pressurizing roller 44 is shaped like a hollow cylinder, and a halogen heater may be provided in an inner space of the pressurizing roller 44.

A base layer of the slide belt 68 is formed of a magnetic material (Ni). The thickness of the base layer is at least less than the magnetic-field permeation depth at a temperature higher than or equal to the Curie temperature of the base layer of the slide belt 68, such as 40 μm. A thin elastic layer (e.g., silicone rubber) having a thickness of about 30 μm is provided on a surface of the base layer, and a release layer (e.g., PFA) having a thickness of about 30 μm is provided on an outer surface of the elastic layer. The slide belt 68 is an endless thin belt that has a diameter of about 30 mm and the temperature of the slide belt 68 is controlled to, for example, a range of about 150° C. to about 200° C. when the slide belt 68 is heated with the induction heating.

The surface temperature of the slide belt 68 can be measured with a non-contact temperature sensor provided outside an outer side of the slide belt 68 in the radial direction and at a predetermined distance from the slide belt 68.

The pressurizing roller 44 is provided with a stepping motor (not shown), and is rotated by power from the stepping motor on an axis extending in the width direction of the conveyed sheet P. By the rotation of the pressurizing roller 44, the slide belt 68 is driven to rotate, and a fixing nip is formed between the slide belt 68 and the pressurizing roller 44.

More specifically, a slide member 80 is disposed on a portion of an inner surface of the slide belt 68 opposing the pressurizing roller 44. The slide member 80 is shaped like a thin plate extending in the above-described axial direction, and is supported at both ends thereof by a cover (not shown) of the fixing unit 14. A lower surface of the fixed slide member 80 is in sliding contact with the inner surface of the rotating slide belt 68. The slide member 80 receives a pressing force from the pressurizing roller 44 over the axial direction, whereby a flat nip for fixing a toner image on the sheet P is formed between the slide belt 68 and the pressurizing roller 44.

Figure 8:
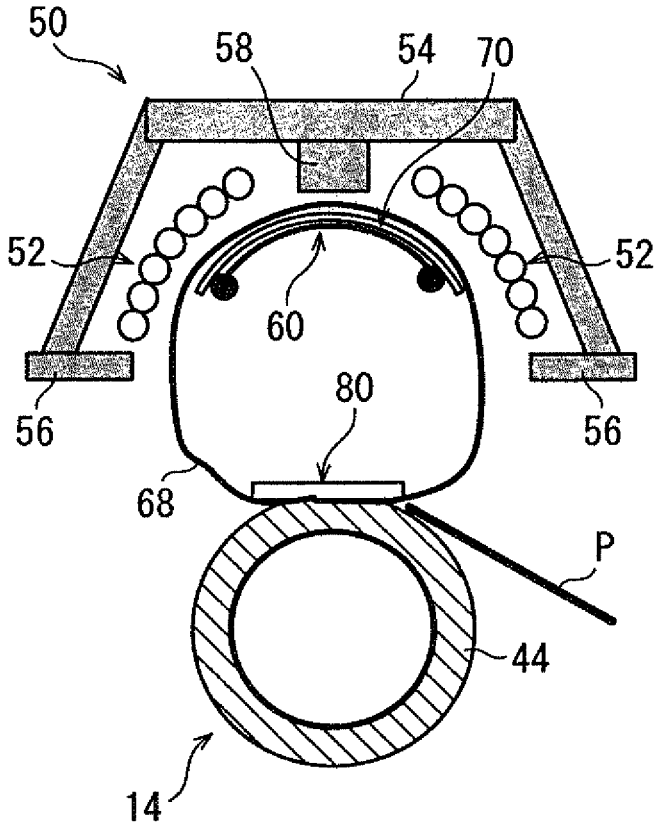
FIG. 8 is a cross-sectional view illustrating another exemplary structure of a fixing unit, in accordance with some embodiments.

In various embodiments such as the embodiment illustrated in FIG. 8, a heat generating member 70 formed of a Fe—Ni alloy is provided at a position opposing a coil 52 with the slide belt 68 being disposed therebetween, that is, in the interior of the slide belt 68. Moreover, the heat generating member 70 is disposed in contact with the inner surface of the slide belt 68. The heat generating member 70 is shaped like a plate curved in an arc form as a whole in side view, and has a thickness less than the magnetic-field permeation depth at the temperature higher than or equal to the Curie temperature of the heat generating member 70, such as 0.2 mm. Hence, when the temperature of the heat generating member 70 is lower than the Curie temperature of the heat generating member 70, magnetic flux generated by the coil 52 substantially travels through inside the heat generating member 70. In contrast, when the temperature of the heat generating member 70 is higher than or equal to the Curie temperature of the heat generating member 70, a leakage flux that penetrates the heat generating member 70 in the thickness direction and travels toward an opposite side of the coil 52, that is, toward the ring member 60 is generated.

Since the ring member 60 is fixed in the orientation such that the leakage flux, which penetrates the slide belt 68 and the heat generating member 70, penetrates an imaginary plane in the rectangle thereof in the substantially perpendicular direction, a diamagnetic field, whose direction is opposite the leakage flux, is generated by an induced current due to the leakage flux in the ring member 60, thereby cancelling the leakage flux for blocking or reducing the leakage flux.

The slide belt 68 may be a thin belt made of a nonmagnetic resin (e.g., PI, 90 μm), or a thin belt made of a nonmagnetic metal (e.g., copper, 5 μm). However, when a belt of 5 μm is made only of copper, it is difficult to maintain the shape of the belt. Hence, the belt made of copper may be supported on a base layer made of PI or the like.

An insulating sheet (insulating member) for heat insulation and electric insulation may be provided between the above-described magnetic shunt metal member, that is, the metal core 46*a* (see FIG. 2) or the heat generating member 70 (see FIG. 8) and the upper surface 61 of the ring member 60. Instead of using the insulating sheet, for example, the ring member 60 may be covered with an insulating tube or an insulating film. Further, a gap (e.g., about 0.5 to about 1 mm) may be provided between the metal core 46*a* or the heat generating member 70, and the upper surface 61 of the ring member 60.

As described above, the heat roller 46 has the cylindrical metal core 46*a* in the embodiment of FIG. 2. The coil 52 of the IH coil unit 50 and the rectangular-shaped ring member 60 oppose each other with the metal core 46*a* being disposed therebetween. As described above, since the release layer is provided on the surface of the metal core 46*a*, the heating belt 48 does not directly contact the metal core 46*a* that generates heat. The metal core 46*a* is formed of a magnetically permeable and electrically conductive magnetic shunt alloy, and has a thickness less than the magnetic-field permeation depth at the temperature higher than or equal to the Curie temperature of the metal core 46*a*.

According to the embodiment of FIG. 8, the flexible thin slide belt 68 is used, and the coil 52 of the IH coil unit 50 and the heat generating member 70 oppose each other with the slide belt 68 being disposed therebetween. Further, the coil 52 and the rectangular-shaped ring member 60 oppose each other with the heat generating member 70 being disposed therebetween. The heat generating member 70 is formed of a magnetically permeable and electrically conductive magnetic shunt alloy, and has a thickness less than the magnetic-field permeation depth at the temperature higher than or equal to the Curie temperature of the heat generating member 70.

By thus combining the heat roller 46 formed of the magnetic shunt alloy or the heat generating member 70 formed of the magnetic shunt alloy with the nonmagnetic and electrically conductive ring member 60, the decrease in heating efficiency can be prevented while maintaining the flux reducing effect, and the heat capacity can be reduced, in contrast to the case in which the heat generation efficiency is reduced or the flux suppressing effect is reduced when the thicknesses of the plate-shaped magnetic shunt alloy layer and the plate-shaped nonmagnetic metal layer, which are used in combination, are reduced. Therefore, the warm-up time and energy consumption can be reduced. As a result, it is possible to meet the request to further reduce the heat capacity.

In addition, since heat of the heat generating member 70 is always transmitted to the slide belt 68 in the embodiment of FIG. 8, the heat capacity can be made much smaller than in the case in which rollers, such as the heat roller and the fixing roller, are used. This more reliably meets the request to further reduce the heat capacity.

Further, since the slide belt 68 is thin in the embodiment of FIG. 8, magnetic flux generated by the coil 52 completely penetrates the slide belt 68, and reaches the heat generating member 70 of the magnetic shunt alloy.

When the slide belt 68 is formed of copper, the slide belt 68 itself can generate heat, and therefore, effectively functions as a heat supply source. In contrast, the slide belt 68 formed of PI does not generate heat and does not function as a heat supply source. However, as described above, the PI slide belt 68 is in contact with the heat generating member 70, and therefore, the above-described reduction of heat capacity is not hindered.

When the slide belt 68 is formed of Ni and has a thickness less than the magnetic-field permeation depth at the temperature higher than or equal to the Curie temperature of the slide belt 68, the shape of the belt formed of only the magnetic metal can be maintained. In the case of the thickness that can maintain the belt shape, the thickness of the heat generating member 70 is added to the thickness of the slide belt 68. Hence, the amount of leakage flux that can travels through inside the heat generating member 70 becomes smaller than when the slide belt 68 is formed by the thin copper belt as described above. Although this has an influence on the flux reducing effect when the temperature of the slide belt 68 reaches the Curie temperature, the slide belt 68 itself can generate heat, and therefore, effectively functions as a heat supply source.

When the sectional area of the ring member 60 is reduced, there is a fear that an induced current will not easily pass therethrough and that the ring member 60 itself will generate heat. However, this fear does not occur by making the above thickness setting. The induced current is efficiently generated when the leakage flux penetrates, and the magnetic flux can be blocked or reduced reliably with the ring member 60.

By dividing the ring member 60, the amount of leakage flux penetrating the rings 60*a*, 60*b*, and 60*c* is reduced. In this case, heat generation of the ring member 60 itself can be prevented further.

By electrically disconnecting the ring member 60, from the metal core 46*a* or the heat generating member 70, the induced current can be prevented from leaking from the ring member 60 to the metal core 46*a* or the heat generating member 70. Further, by avoiding heat conduction from the metal core 46*a* or the heat generating member 70 to the ring member 60, heat of the magnetic shunt alloy can be effectively utilized. This also contributes to reduction of heat capacity of the fixing device.

In addition, a small heat capacity is enough, and an excessive temperature rise in the area of the metal core 46*a* or the heat generating member 70 where the sheet P is not conveyed is prevented. This improves the quality of toner images and also improves reliability of the image forming apparatus 1.

The present disclosure is not limited to the above-described embodiments, and various modifications are possible. For example, the center core may be fixed or be rotatable.

While the metal core 46*a* of the heat roller 46 is adopted in the above embodiments, the heat roller 46 may be omitted when, for example, the metal core of the fixing roller 45 is formed of a magnetic shunt alloy and the heating belt 48 can be wound around the fixing roller 45. In other words, the rotating fixing body according to various embodiments of the present disclosure includes not only the heat roller but also the fixing roller.

In the above embodiments, the coil 52 of the IH coil unit 50 is arranged along the outer surface of the slide belt 68. However, the coil 52 can be provided in the slide belt 68 and the heat generating member 70 and the ring member 60 can be provided on the outer side of the slide belt 68 as long as the coil 52 and the heat generating member 70 can oppose each other with the slide belt 68 being disposed therebetween and the coil 52 and the rectangular-shaped ring member 60 can oppose each other with the heat generating member 70 being disposed therebetween.

While the image forming apparatuses of the embodiments are embodied by the printer, the image forming apparatus of the present disclosure is also applicable to a multi-functional peripheral, a copying machine, and a facsimile machine. In any case, the heat capacity of the fixing device can be further reduced, similarly to the above embodiments. Also, as noted above, values, such as dimensions and/or dimensional ranges, resistivity, etc., provided in the foregoing embodiments are merely illustrative and are not intended to be limiting of the present disclosure.

Having thus described in detail embodiments of the present disclosure, it is to be understood that the disclosure disclosed by the foregoing paragraphs is not to be limited to particular details and/or embodiments set forth in the above description, as many apparent variations thereof are possible without departing from the spirit or scope of the present invention.

What is claimed is:

1. A fixing device comprising:

a rotating fixing body configured to rotate on an axis extending in a width direction of a recording medium to be conveyed and configured to fix a toner image on the recording medium by heating, the rotating fixing body having a cylindrical metal core formed of a magnetic shunt alloy and having a thickness less than a magnetic-field permeation depth at a temperature higher than or equal to a Curie temperature of the metal core;

a coil provided along an outer surface of the rotating fixing body, the coil configured for generating magnetic flux that subjects the rotating fixing body to induction heating; and an electrically conductive arch-shaped saddle ring member, the ring member being disposed at a position opposing the coil with the metal core being disposed therebetween and in an orientation such that magnetic flux leakage associated with loss of ferromagnetism of the metal core penetrates a hollow portion defined by a frame of the ring member to induce in the ring a current that generates a magnetic field that opposes the magnetic flux leakage.

2. The fixing device according to claim 1, wherein the ring member includes two linear portions parallel to an axial direction of the rotating fixing body and two arch-shaped portions that connect longitudinal ends of the two linear portions.

3. The fixing device according to claim 1, wherein the ring member is divided into a plurality of parts in an axial direction of the rotating fixing body.

4. The fixing device according to claim 3, wherein the plurality of parts of the ring member are arranged symmetrically with respect to a center of the rotating fixing body in the axial direction.

5. The fixing device according to claim 3, wherein the plurality of parts of the ring member is arranged in correspondence to widthwise lengths of a plurality of the recording medium to be conveyed.

6. The fixing device according to claim 1, wherein the ring member is formed of copper and has a thickness of at least about 0.1 mm.

7. The fixing device according to claim 1, wherein the rotating fixing body is a heat roller that includes the metal core.

8. The fixing device according to claim 1, wherein an insulating member or a gap for heat insulation and electric insulation is provided between the ring member and the metal core.

9. The fixing device according to claim 1, further comprising a core member provided in a center of the coil, wherein the ring member is disposed so that the hollow portion of the ring member faces the center core.

10. A fixing device comprising:

a heat generating member formed of a magnetic shunt alloy and having a thickness less than a magnetic-field permeation depth at a temperature higher than or equal to a Curie temperature of the heat generating member;

a flexible fixing belt member configured to rotate on an axis extending in a width direction of a recording medium to be conveyed while being in contact with the heat generating member, the fixing belt member being operable in fixing a toner image on the recording medium by heating;

a coil provided along the fixing belt member, the coil configured for generating magnetic flux that penetrates the fixing belt member so as to subject the heat generating member to induction heating; and an electrically conductive arch-shaped saddle ring member, the ring member being disposed at a position opposing the coil with the heat generating member being disposed therebetween and in an orientation such that magnetic flux leakage associated with loss of ferromagnetism of the heat generating member penetrates a hollow portion defined by a frame of the ring member to induce in the ring a current that generates a magnetic field that opposes the magnetic flux leakage.

11. The fixing device according to claim 10, wherein the ring member includes two linear portions parallel to an axial direction of the fixing belt member and two arch-shaped portions that connect longitudinal ends of the two linear portions.

12. The fixing device according to claim 10, wherein the ring member is divided into a plurality of parts in an axial direction of the fixing belt member.

13. The fixing device according to claim 12, wherein the plurality of parts of the ring member are arranged symmetrically with respect to a center of the fixing belt member in the axial direction.

14. The fixing device according to claim 12, wherein the plurality of parts of the ring member is arranged in correspondence to widthwise lengths of a plurality of the recording medium to be conveyed.

15. The fixing device according to claim 10, wherein the ring member is formed of copper and has a thickness of at least about 0.1 mm.

16. The fixing device according to claim 10, wherein an insulating member or a gap for heat insulation and electric insulation is provided between the ring member and the heat generating member.

17. The fixing device according to claim 10, further comprising a core member provided in a center of the coil, wherein the ring member is disposed so that the hollow portion of the ring member faces the center core.

18. An image forming apparatus comprising:

an image forming section configured to form a toner image;

a transfer section that is operable to transfer the toner image onto a recording medium to be conveyed; and a fixing device that is operable to fix the transferred toner image on the recording medium, wherein the fixing device includes:

a rotating fixing body configured to rotate on an axis extending in a width direction of the recording medium and configured to fix the toner image on the recording medium by heating, the rotating fixing body having a cylindrical metal core formed of a magnetic shunt alloy and having a thickness less than a magnetic-field permeation depth at a temperature higher than or equal to a Curie temperature of the metal core, a coil provided along an outer surface of the rotating fixing body, the coil operable for generating magnetic flux that subjects the rotating fixing body to induction heating, and an electrically conductive arch-shaped saddle ring member, the ring member being fixed at a position opposing the coil with the metal core being disposed therebetween and in an orientation such that magnetic flux leakage associated with loss of ferromagnetism of the metal core penetrates a hollow portion defined by a frame of the ring member to induce in the ring a current that generates a magnetic field that opposes the magnetic flux leakage.

19. An image forming apparatus comprising:

an image forming section configured to form a toner image;

a transfer section operable to transfer the toner image onto a recording medium to be conveyed; and a fixing device operable to fix the transferred toner image on the recording medium, wherein the fixing device includes:

a heat generating member formed of a magnetic shunt alloy and having a thickness less than a magnetic-field permeation depth at a temperature higher than or equal to a Curie temperature of the heat generating member, a flexible fixing belt member configured to rotate on an axis extending in a width direction of the recording medium while being in contact with the heat generating member, the fixing belt member being operable in fixing the toner image on the recording medium by heating, a coil provided along the fixing belt member, the coil operable for generating magnetic flux that penetrates the fixing belt member so as to subject the heat generating member to induction heating, and an electrically conductive arch-shaped saddle ring member, the ring member being disposed at a position opposing the coil with the heat generating member being disposed therebetween and in an orientation such that magnetic flux leakage associated with loss of ferromagnetism of the heat generating member penetrates a hollow portion defined by a frame of the ring member to induce in the ring a current that generates a magnetic field that opposes the magnetic flux leakage.

* * * * *